United States Patent [19]

Van Daele

[11] Patent Number: 4,598,496

[45] Date of Patent: Jul. 8, 1986

[54] STORAGE BIN LID CLOSING MECHANISM

[75] Inventor: Antoine Van Daele, Milford, Ind.

[73] Assignee: Brock Manufacturing Company, Milford, Ind.

[21] Appl. No.: 527,002

[22] Filed: Aug. 29, 1983

[51] Int. Cl.[4] ..... E05F 11/00

[52] U.S. Cl. ..... 49/357; 49/344; 49/343

[58] Field of Search ..... 49/357, 339-343, 49/344, 356

[56] References Cited

U.S. PATENT DOCUMENTS

| | | | |
|---|---|---|---|
| 1,615,878 | 2/1927 | Laird | 49/340 |
| 2,592,891 | 4/1952 | Hall | 49/340 |
| 3,733,764 | 5/1973 | Hege | 49/357 |
| 4,208,839 | 6/1980 | Candy, Sr. | 49/357 X |
| 4,327,522 | 5/1982 | Meadows | 49/357 X |

OTHER PUBLICATIONS

Brock Bins: *Brock Grain Bins,* especially pp. 2 and 3, published Mar. 1981.

Brock Bins: *Feed-Wet Grain-Industrial Uses,* especially pp. 2 and 3, published Jan. 1981.

Chore-Time: *Swine Confinement Systems,* especially p. 8, published Sep. 1979.

*Primary Examiner*—Kenneth Downey

*Attorney, Agent, or Firm*—Trexler, Bushnell & Wolters, Ltd.

[57] ABSTRACT

Disclosed here is a lid moving mechanism for use with a storage bin. A hinge arm is pivoted at one end to a fixed point on the bin top, and a free end is attached, by a boom, to the lid. A jack device rotates the hinge arm and lid between opened and closed positions. The jack takes the form of a tube, within which is fixed an open-center helical spindle. A turning tube is inserted into this spindle, and a pin engages the spindle windings. When the turning tube is rotated, it is drawn into or forced out of the helical spindle and jack tube, and the hinge arm is correspondingly moved. An extension is attached to the turning tube so that the jack can be operated, and the lid moved, from a remote location.

11 Claims, 6 Drawing Figures

STORAGE BIN LID CLOSING MECHANISM

BACKGROUND OF THE INVENTION

This invention relates generally to devices for opening and closing bin lids.

Grain and other storage bins are ubiquitous in modern agricultural and industrial settings. They are used to store grains, foods, and other materials for livestock consumption or industrial use. Many of these bins are provided at their tops with fill openings, and closure lids cap outside bin openings with a more or less weatherproof fit.

In the past, a lid for a typical feed storage bin has been mounted on a pivotally supported arm, so that the lid can be swung to an open position by an operator pulling on a chain or other mechanism from a ground level. The chain is then latched in some fashion to support the lid in its open position, and the bin is then filled. In order to close the lid, the chain is released, and the lid lowers itself by gravity to the closed position. When the bin is a tall one, the operator standing on the ground cannot see the lid, and cannot be sure that the lid has fully and securely closed over the bin opening. In addition, the operator cannot be sure that the lid will not be inadvertently blown partially open by wind during inclement weather.

It is accordingly an object of the present invention to provide a bin lid opening and closing system which permits an operator, standing at a remote location from the bin lid, to positively raise the lid and open the bin, and also to positively lower the lid and close the bin. A related object is to provide a system for closing the lid so that the lid cannot be opened by wind or other forces.

Another object is to provide such a positive bin lid opening and closing system which is reliable in operation and rugged in use, so as to provide a long but inexpensive service life.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 2:
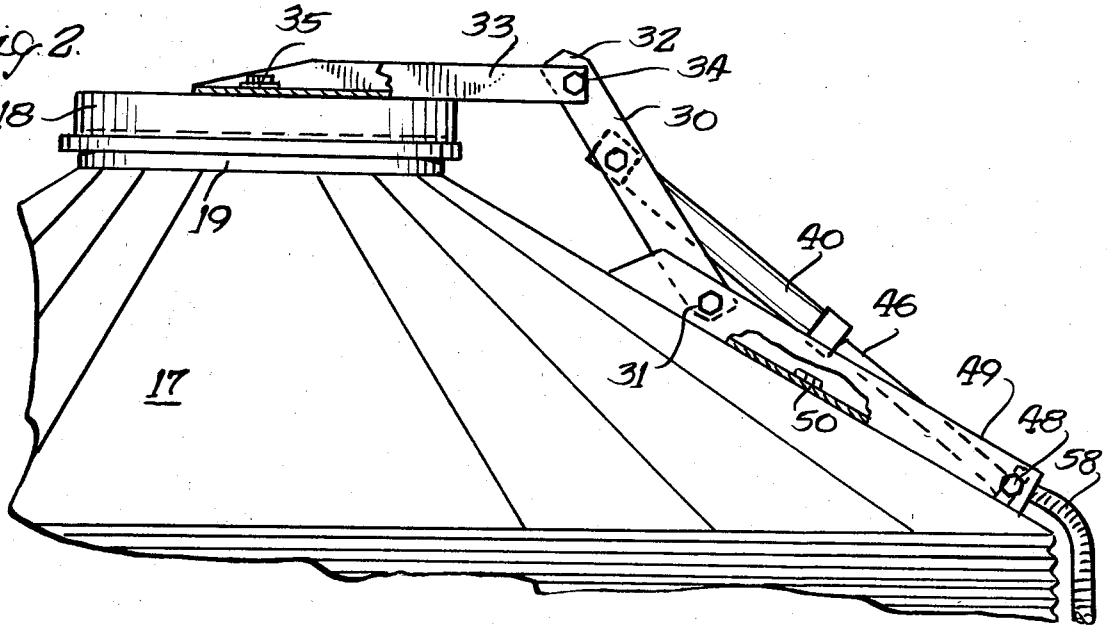
FIG. 2 is a fragmentary elevational view showing in further detail the lid-moving mechanism and the associated lid and bin as they appear when the lid is in a closed position.
Figure 1:
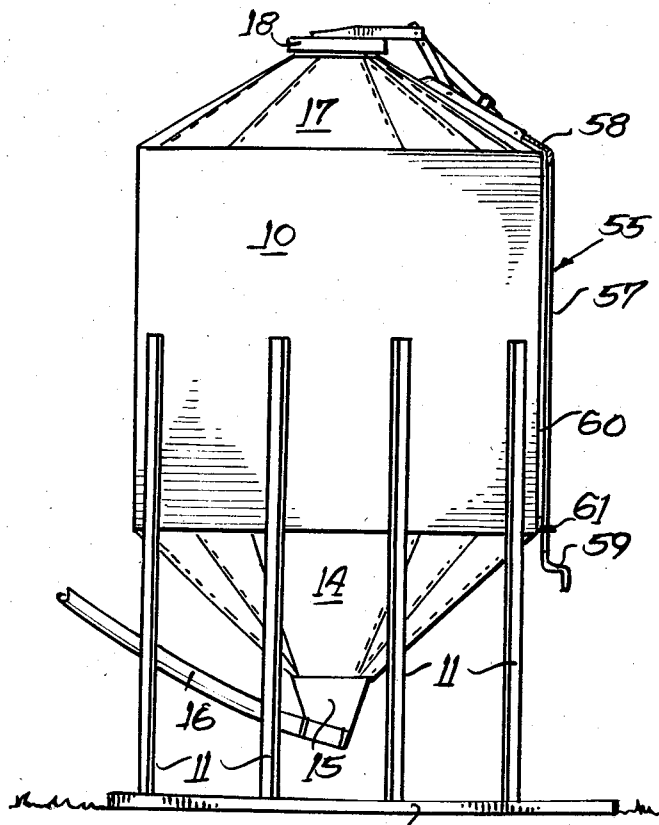
FIG. 1 is an elevational view of a bin equipped with the novel lid opening and closing mechanism.
Figure 4:
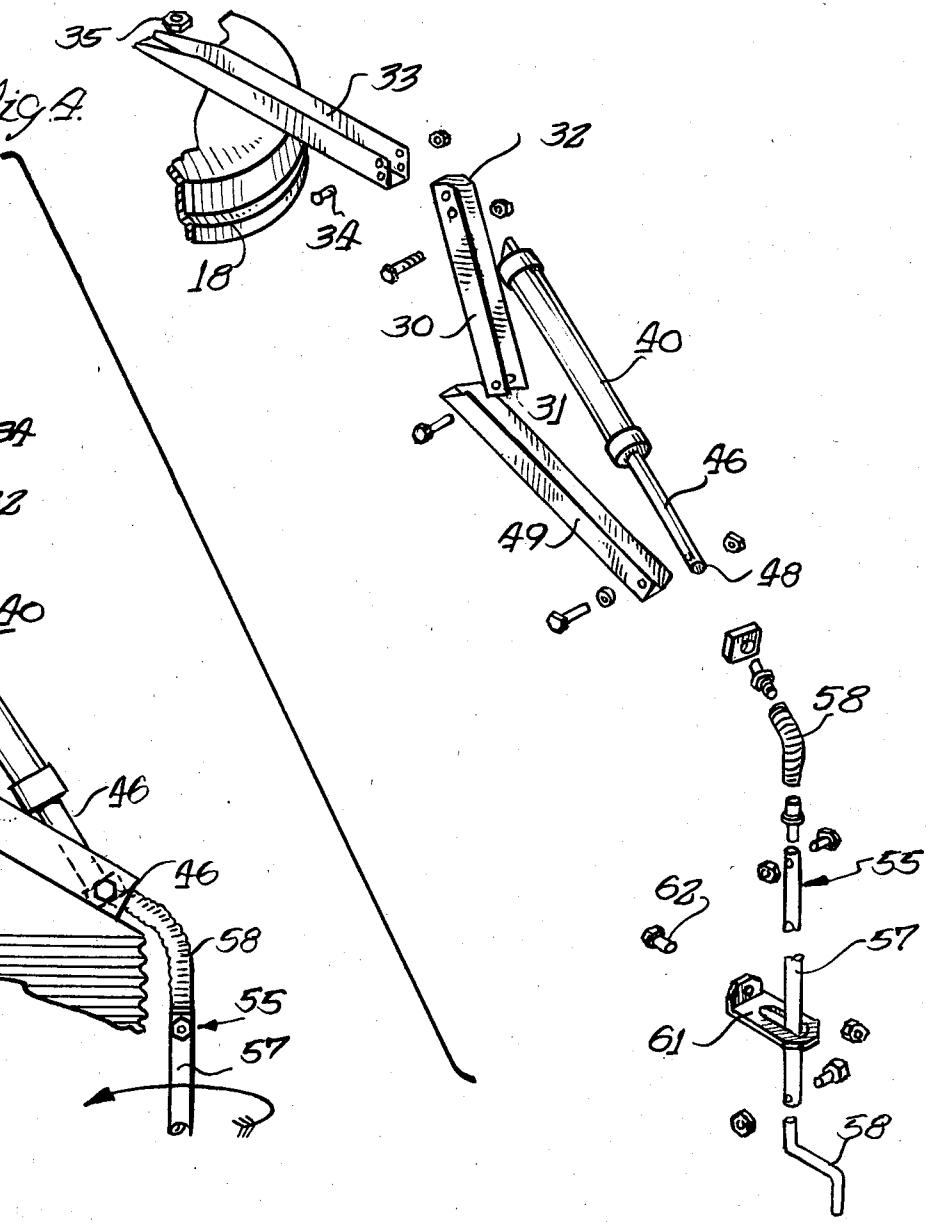
FIG. 4 is an exploded view of the lid-moving mechanism parts.
Figure 3:
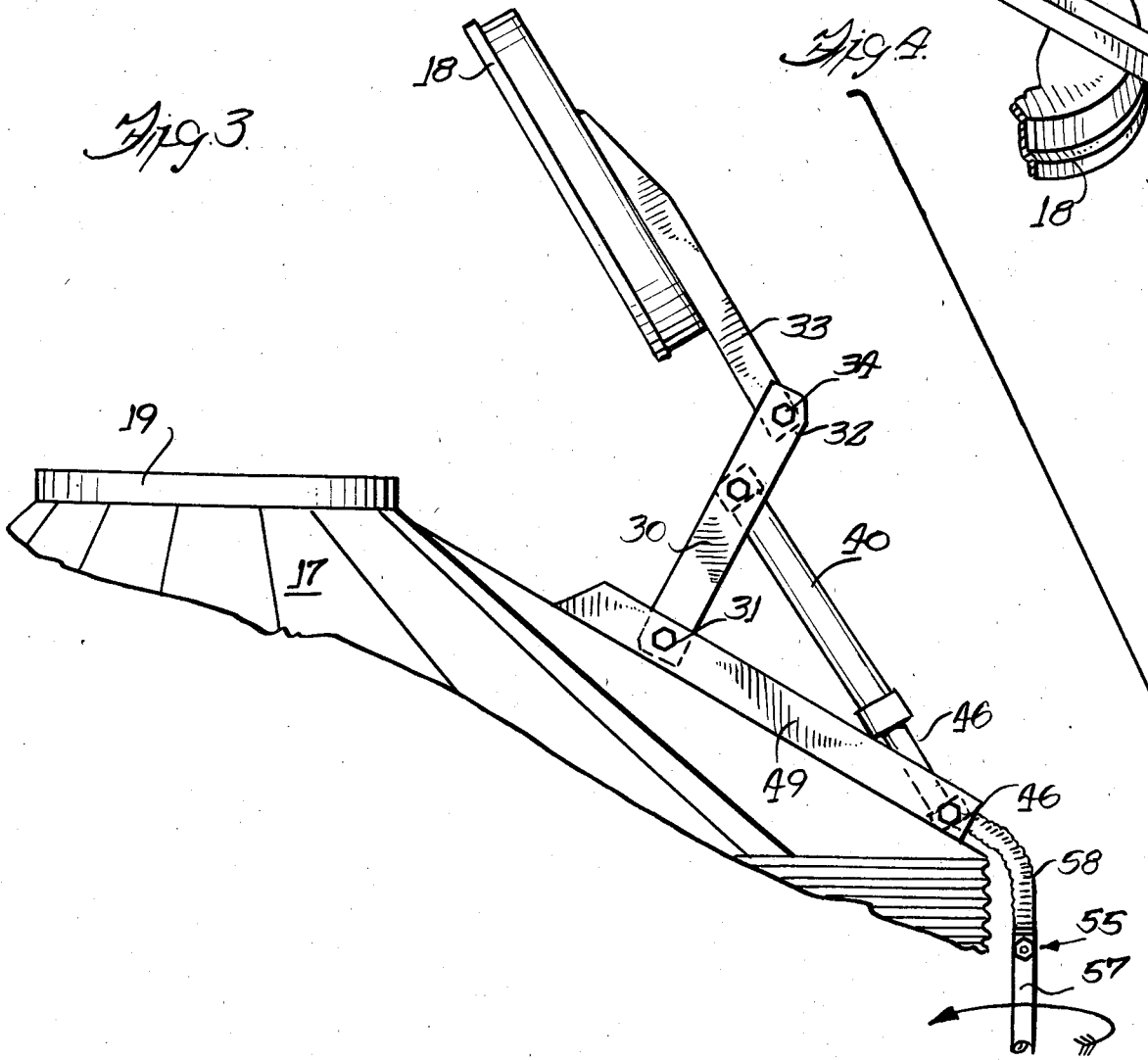
FIG. 3 is a fragmentary elevational view similar to FIG. 2 but showing the lid in an open position.

Turning more particularly to FIGS. 1-3, there is shown a typical agricultural bin 10, which is supported by legs 11 upon a foundation such as a concrete pad 12. From a conical bin bottom 14, a boot 15 leads to a conveyor system 16 for transporting the contained feed or other materials to downstream apparatus (not shown) such as animal feeding equipment. This bin has a conical top 17 capped by a lid 18. As indicated especially in FIGS. 2 and 3, the bin lid 18 can be moved to an open position to permit feed or other materials to be poured into the bin interior. In its closed position, the lid 18 fits more or less securely over and atop an annular mouth 19 so as to exclude rain, snow, and other weather from the bin interior.

In accordance with the invention, a reliable, rugged opening and closing mechanism is provided to move the lid between the opened and closed positions (shown, respectively, in FIGS. 3 and 2). Here, the lid moving mechanism comprises a bi-ended hinge arm 30 pivotable about one of its ends 31. At a free arm end 32, a lid boom 33 is attached by several bolts 34, and the boom 33 extends to and carries the lid 18. If desired, this boom connection can be flexible but secure, as by providing a long bolt 35. A novel jack 40 provides positive motion of the hinge arm 30 and attached lid 18.

Figure 5:
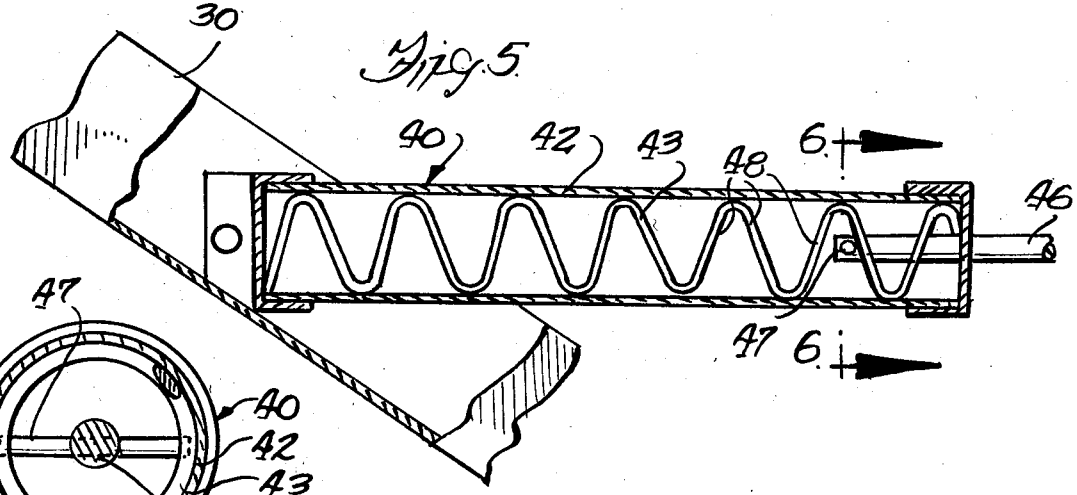
FIG. 5 is an elevational view of the closure tube, partially broken away to show the spindle mechanism inside.

To provide this positive opening and closing action in accordance with the invention, the jack 40 here includes a tube 42, within which is fixed a helical spindle member 43, as shown especially in FIG. 5. For convenience and economy in the invention, this helical spindle can be formed of a length of spring steel such as that used in open-center auger feed conveying mechanisms designed for use in animal husbandry operations. Such helical spring steel elements are available from Chore-Time Equipment, Inc., of Milford, Indiana.

Figure 6:
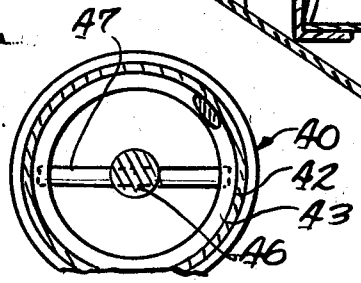
FIG. 6 is a sectional view taken substantially in the plane of line 6—6 in FIG. 5.

A turning shaft member 46 is adapted to rotatably engage the spindle 43 and move in and out of the tube 42 and spindle 43. To this end, a pin 47 extends perpendicularly or radially outwardly from the turning shaft 46 so as to engage the windings 48 of the spindle 43. Now, as can be envisioned from FIGS. 5 and 6, as the winding tube 46 is rotated, the pin 47 follows the helix windings 48, and draws the winding tube 46 into (or forces the tube 46 out of) the spindle 43 and the enclosing tube 42. It will also be noted that the turning tube 46 is journaled or secured for rotation at a free end 48. Here, the journaling is made to a foundation brace 49 which can be secured, as by a bolt 50, to the top 17 of the bin 10. In this way, rotation of the turning tube axially extends or contracts the jack 40, and rotates the hinge arm 30 to open or close the bin lid 18.

To permit the bin user or operator to open and close the bin lid 18 from a ground level in accordance with another aspect of the invention, an extension means 55 is provided for rotating the turning shaft 46 from a remote location. Here, the extension means 55 can be economically yet effectively provided by a crank shaft 57 connected, by a universal joint 58, to the turning shaft 46. A manually operable crank 59 is connected at the bottom of the crank shaft 57.

A bracket 61 is attached, as by a bolt 62 or other convenient means, to the side 60 of the bin 10. Since the universal joint 58 here takes the form of a coil spring, that spring tends to urge the crank shaft 57 in an outward position so as to be generally axially aligned with the jack turning tube 46. This bracket 61, however, retains the crank shaft 57 in a proper position against a side of the bin 10, as suggested in FIG. 1.

When it is desired to open the top 18, the operator moves the crank shaft 57 out of the bracket 61 and turns the crank 59. The crank shaft 57 turns the tube 46, and the lid 18 opens away from the mouth 19 into the position shown in FIG. 3. After the bin has been filled, the operator rotates the crank 59 in the opposite direction to positively close the bin and secure the lid 18 over the mouth 19 as shown in FIG. 2. In this position, the interaction of the turning tube 46 and helix 43 will prohibit the lid 18 from being inadvertently opened by wind or other forces.

The invention is claimed as follows:

1. A lid moving mechanism for use with a bin having a lid, comprising, in combination, a bi-ended hinge arm pivotable about one arm end, means for attaching the lid to the other hinge arm end, and jack means for moving the hinge arm and attached lid between open and closing positions on the bin, said jack means comprising tube means, a helical spindle fixed within said tube means and turning shaft means adapted to rotatably engage the spindle and move into and out of the tube means and spindle, extension means for rotating the turning shaft means from a remote location and said extension means including universal joint means comprising spring means connected to the turning shaft means, crankshaft means connected to the spring means and rotor means for rotating the crankshaft means, universal joint means and turning shaft means from said remote location.

2. A device according to claim 1 further including lid boom means extending from the hinge arm toward the center of the lid.

3. A lid moving device according to claim 1 wherein the helical spindle has an open center, and the device further includes pin means extending outwardly from the turning shaft means for engaging the windings of the spindle, whereby to cause the turning shaft to wind itself into and out of the helical spindle when the turning shaft is rotated.

4. A device according to claim 1 wherein said helical spindle is formed of a length of an open-center helical auger.

5. A device according to claim 1 further including bracket means for retaining said crank shaft means against a side of the bin.

6. A device according to claim 5 wherein said universal joint spring means is adapted to retain said crank shaft means in said bracket.

7. A lid moving device for use with a bin having a lid, comprising, in combination, a jack having a tube means, an open center helical spring fixed within the tube, and turning shaft means extending centrally into said spring adapted to engage the spring and be advanced into and out of the tube means, one of the tube means or turning shaft means being at least indirectly attached to the lid, and the other being at least indirectly attached to the bin, so as to move the lid relative to the bin when the turning shaft and spring are rotated relative to one another.

8. A device according to claim 7 further including a bi-ended hinge arm pivotally mounted to the bin at one arm end, and pivotally mounted to one of the jack means at an opposite end, for causing the attached hinge arm end to undergo arctuate motion.

9. A device according to claim 7 further including lid boom means extending from one of the jack means to the lid.

10. A device according to claim 9 further including pin means extending from the turning shaft means to the helical spring for engaging the windings of the spring, whereby relative rotation between the turning shaft means and the helical spring causes extension or retraction of the turning shaft means into or out of the spring and tube means.

11. A device according to claim 7 further including extension means for rotating the turning shaft means or spring from a remote location.

* * * * *